US006282400B1

(12) United States Patent
Aoki et al.

(10) Patent No.: US 6,282,400 B1
(45) Date of Patent: Aug. 28, 2001

(54) IMAGE-FORMING APPARATUS AND IMAGE FORMING METHOD USING A CONTROLLED DYNAMIC FRICTIONAL FORCE BETWEEN A CLEANING BLADE AND A PHOTOSENSITIVE MEMBER

(75) Inventors: Makoto Aoki, Joyo; Shigenori Ueda; Junichiro Hashizume, both of Nara; Ryuji Okamura, Kyoto, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/321,126

(22) Filed: May 27, 1999

(30) Foreign Application Priority Data

Jun. 1, 1998 (JP) ..... 10-151477
Nov. 30, 1998 (JP) ..... 10-340311

(51) Int. Cl.[7] ..... G03G 21/00
(52) U.S. Cl. ..... 399/350
(58) Field of Search ..... 399/350, 351

(56) References Cited

U.S. PATENT DOCUMENTS

| | | | | |
|---|---|---|---|---|
| 4,471,042 | * | 9/1984 | Komatsu et al. | 430/64 |
| 4,484,809 | * | 11/1984 | Coleman | 430/64 X |
| 4,898,798 | | 2/1990 | Sugata et al. | 430/58 |
| 5,211,864 | * | 5/1993 | Godlove | 399/350 X |
| 5,521,691 | * | 5/1996 | Morimoto et al. | 399/350 |
| 5,670,286 | | 9/1997 | Takei et al. | 430/66 |

FOREIGN PATENT DOCUMENTS

| | | | |
|---|---|---|---|
| 0 314 579 | | 5/1989 | (EP) . |
| 54-86341 | | 7/1979 | (JP) . |
| 60-59380 | * | 4/1985 | (JP) . |
| 61-59383 | * | 3/1986 | (JP) . |
| 62-75575 | * | 4/1987 | (JP) . |
| 3-243965 | * | 10/1991 | (JP) . |
| 3-293388 | * | 12/1991 | (JP) . |
| 4-335387 | * | 11/1992 | (JP) . |
| 5-88597 | | 4/1993 | (JP) . |
| 5-165384 | * | 7/1993 | (JP) . |
| 5-241375 | * | 9/1993 | (JP) . |
| 8-123279 | | 5/1996 | (JP) . |
| 9-127843 | * | 5/1997 | (JP) . |
| 9-297511 | | 11/1997 | (JP) . |

OTHER PUBLICATIONS

"Influence of Plasma Excitation Frequency for α–Si:H Thin Film Deposition", H. Curtins et al., Plasma Chemistry and Plasma Processing, vol. 7, No. 3, 1987, pp. 267 through 273.

* cited by examiner

*Primary Examiner*—Fred L. Braun
(74) *Attorney, Agent, or Firm*—Fitzpatrick, Cella, Harper & Scinto

(57) ABSTRACT

An image forming apparatus and method uses an electrophotographic photosensitive member that includes a conductive substrate. The photosensitive member has a photoconductive layer thereon formed of a non-single-crystal material mainly composed of at least silicon atoms. Charging, exposure, development and cleaning in the image forming arrangement are repeated while the photosensitive member rotates. The dynamic frictional force (unit: gf) produced when the photosensitive member surface is cleaned by a cleaning blade to remove a developer remaining on that surface is so set that its standard deviation in its change with time is 2 gf or below per 1 gf/cm of linear pressure of the cleaning blade. No melt-adhesion of toner results and durability is high enough to stably obtain images of high quality.

19 Claims, 6 Drawing Sheets

IMAGE-FORMING APPARATUS AND IMAGE FORMING METHOD USING A CONTROLLED DYNAMIC FRICTIONAL FORCE BETWEEN A CLEANING BLADE AND A PHOTOSENSITIVE MEMBER

BACKGROUND OF THE INVENTION

1. Field of the Invention

This invention relates to an image-forming apparatus and an image-forming method, and more particularly to an image-forming apparatus and an image-forming method which are used to form a high-quality image by electrophotography.

2. Related Background Art

As techniques for element members used in electrophotographic photosensitive members, various materials are proposed, as exemplified by selenium, cadmium sulfide, zinc oxide, phthalocyanine and amorphous silicon (hereinafter "a-Si"). In particular, non-single-crystal deposited films containing silicon atoms as a main component as typified by a-Si films, e.g., amorphous deposited films such as an a-Si film compensated with hydrogen and/or halogen (e.g., fluorine or chlorine), are proposed as photosensitive members having a high performance and a high durability and free of environmental pollution. Some of these have been put into practical use. Japanese Patent Application Laid-Open No. 54-86341 discloses a technique of an electrophotographic photosensitive member whose photoconductive layer has been formed chiefly of a-Si.

As a process for forming electrophotographic amorphous silicon deposited films, a plasma CVD (chemical vapor deposition) process, which is a process of forming a thin-film deposited film on a substrate of glass, quartz, heat-resistant synthetic resin film, stainless steel or aluminum by decomposing material gases by glow discharge using direct current or high frequency (RF or VHF) power or microwaves, has been put into practical use in a very advanced state. Apparatus therefor are also proposed in variety.

In addition, in recent years, there is an increasing demand for the improvement in film quality and processing capability, and various means therefor are on study.

In recent years, there is a report on plasma CVD making use of a high-frequency power source, using a parallel-plate plasma CVD system (Plasma Chemistry and Plasma Processing, Vol.7, No.3, 1987, pp.267–273). This report shows a possibility that deposition rate can be improved by making discharge frequency higher than conventional 13.56 MHz, without damaging the performance of deposited films, and attracts notice. This report on making discharge frequency higher is also made in respect of sputtering, and studies thereon have been widely made in recent years.

In electrophotographic process employing such photosensitive members, the step of transferring to a recording medium such as paper a toner image formed on the surface of a photosensitive member is repeated to form images, where residual toner remaining on the photosensitive member surface must be completely removed every time the toner image is transferred. As a cleaning assembly therefor, an assembly is available which is so constructed that a rubber blade made of an elastic material such as urethane rubber is brought into pressure contact with the photosensitive member surface to remove the residual toner. This cleaning assembly has a simple construction, is small-sized and of low-cost and has a good function to remove toner, and hence has been put into practical use in low-speed machines and to high-speed machines.

Various studies are made on a technique for reducing friction between blade and photosensitive member. For example, Japanese Patent Application Laid-Open No. 8-123279 discloses a cleaning assembly for reducing a frictional force. Japanese Patent Application Laid-Open No. 5-88597 discloses a cleaning assembly that can prevent uneven contact or faulty cleaning.

In recent years, because of higher requirements for copied images, it is earnestly sought to establish a technique which can stably provide high image quality. Copying machines of different types are increasingly required to be made more highly precise, more high-speed, more digital, smaller-sized and more low-cost. Under such circumstances, with regard to the higher precision, toners are being made to have smaller particle diameter, and it has become popular to use toners of 0.005 to 0.008 mm in weight-average particle diameter as measured with a Coulter counter or the like.

With regard to the higher speed, such toners with small particle diameter must be improved in their fixing performance, but, as a conflicting fact, it becomes likely that melt-adhesion to photosensitive member (a phenomenon that components of a toner stick to the photosensitive member surface to cause faulty images) occurs. Also, the fact that the particle diameter is small is in itself in the direction of being disadvantageous to the melt-adhesion.

More specifically, when the toner with small particle diameter is removed by cleaning, the contact pressure of a blade must be changed so that the toner can be prevented from slipping through the blade. This, however, may result in a larger frictional force concurrently with the high-speed process, thus the matter can be said to be causative of the melt-adhesion.

Once the toner has melt-adhered to the photosensitive member surface, no image is formed at the melt-adhered areas because no imagewise exposing light is transmitted there, and this appears as minute black dots on the images. Also, once the melt-adhesion has occurred, even if it does not appear on the copied images at the initial stage, the melt-adhesion grows in the rotational direction with repetition of copying and come to cause line-shaped faulty images. Different from photosensitive members that are changed for new ones after copying on tens of thousands of sheets as in the case of organic photosensitive members, a-Si photosensitive members run on for a greater number of sheets. Accordingly, the occurrence of faulty images due to melt-adhesion is a problem that can not be ignored. To remove the grown melt-adhered toner, it is effective to abrade the surface with alumina powder or the like. In practice, however, the photosensitive member is changed for new one which results in a greatly high running cost. Hence, in order to advance the lower running cost, it is important to prevent the melt-adhesion of toner from occurring and growing.

With regard to this phenomenon of melt-adhesion of toner to the photosensitive member surface, the friction between the blade and the photosensitive member is considered to be a cause. Under the existing conditions, however, its detailed mechanism has not been found.

In order to prevent the melt-adhesion of toner, measures may be taken such that the blade is made to have a high hardness so that its ability to scrape off the toner having adhered can be improved, and the surface of the photosensitive member is modified so that the toner may adhere to the photosensitive member with difficulty. However, in the case where the blade is made to have a higher hardness, the properties of blade materials approach a state of glass from a state of rubber. Hence, the blade is improved in the ability to scrape off the toner but comes to be brittle, and it has become likely that the blade is broken to cause faulty cleaning. Also, in the case where the photosensitive member surface is modified, the frictional force may increase with an increase in process speed, resulting in an increase in abrasive force. Thus, it has become likely that the surface of the photosensitive member is scraped however it is modified and made highly effective, unless materials are selected carefully.

Accordingly, it has been sought to establish a copying process in which the photosensitive member surface has a high hardness and is not scraped even under sever conditions as in the high-speed process making use of toners with small particle diameter, and also may cause no melt-adhesion of toner and no deterioration of such function over a long period of time even when copies are taken on a great number of sheets.

It has also been sought to establish a copying process in which images with a high quality level can be formed over a long period of time, no faulty cleaning may occur, and a reduction of maintenance cost can be achieved because of a blade made to have a long service life and a photosensitive member made to have a long service life.

SUMMARY OF THE INVENTION

An object of the present invention is to provide an image-forming apparatus and an image-forming method which can form highly minute and high-quality images even in severe environment, do not cause any melt-adhesion of toner to the photosensitive member surface and also promise a durability high enough for such properties to be maintained.

Another object of the present invention is to provide an image-forming apparatus and an image-forming method which do not cause any faulty cleaning or uneven scrape and can stably form images with a high quality without any changes with time.

Still another object of the present invention is to provide an image-forming apparatus and an image-forming method which allow a broader latitude for the contact pressure of a cleaning blade, bring about a great improvement in the service life of cleaning blades and photosensitive members and also make it possible to achieve a good cleaning performance.

To achieve the above objects, the present invention provides an image-forming apparatus comprising an electrophotographic photosensitive member comprising a conductive substrate and having thereon a photoconductive layer formed of a non-single-crystal material mainly composed of silicon atoms at least; charging, exposure, development and cleaning being repeated while rotating the photosensitive member;

the image-forming apparatus having a cleaning blade for cleaning the surface of the photosensitive member to remove a developer remaining on that surface; and dynamic frictional force (unit: gf) produced between the cleaning blade and the photosensitive member surface being so set that its standard deviation in its change with time is 2 gf or below per 1 gf/cm of linear pressure of the cleaning blade.

The present invention provides an image-forming method making use of an electrophotographic photosensitive member comprising a conductive substrate and having thereon a photoconductive layer formed of a non-single-crystal material mainly composed of silicon atoms at least; charging, exposure, development and cleaning being repeated while rotating the photosensitive member; wherein;

in a cleaning step for cleaning the surface of the photosensitive member with a cleaning blade to remove a developer remaining on that surface, dynamic frictional force (unit: gf) produced between the cleaning blade and the photosensitive member surface is so set that its standard deviation in its change with time is 2 gf or below per 1 gf/cm of linear pressure of the cleaning blade.

DESCRIPTION OF THE PREFERRED EMBODIMENTS

The particulars of how the problems discussed above have been solved will be explained below.

From various angles, the present inventors have made studies on cleaning methods that may cause no melt-adhesion of toner and also may cause no faulty cleaning.

As one of studies, the frictional force which acts between a photosensitive member and a cleaning blade by rubbing movement via toner was measured in detail by attaching a sensor to the cleaning blade. As a result, any remarkable difference did not appear in respect of frictional force, but it happened to be found that differences between materials were seen in scatterings in time (standard deviation) of the data obtained by measuring the frictional force. Friction causes microscopic variations. It is considered that it was possible to discover such microscopic variations because, in the test made this time, the data were gained by relatively strict measurement made at intervals of 2.5 msec.

Figure 1:
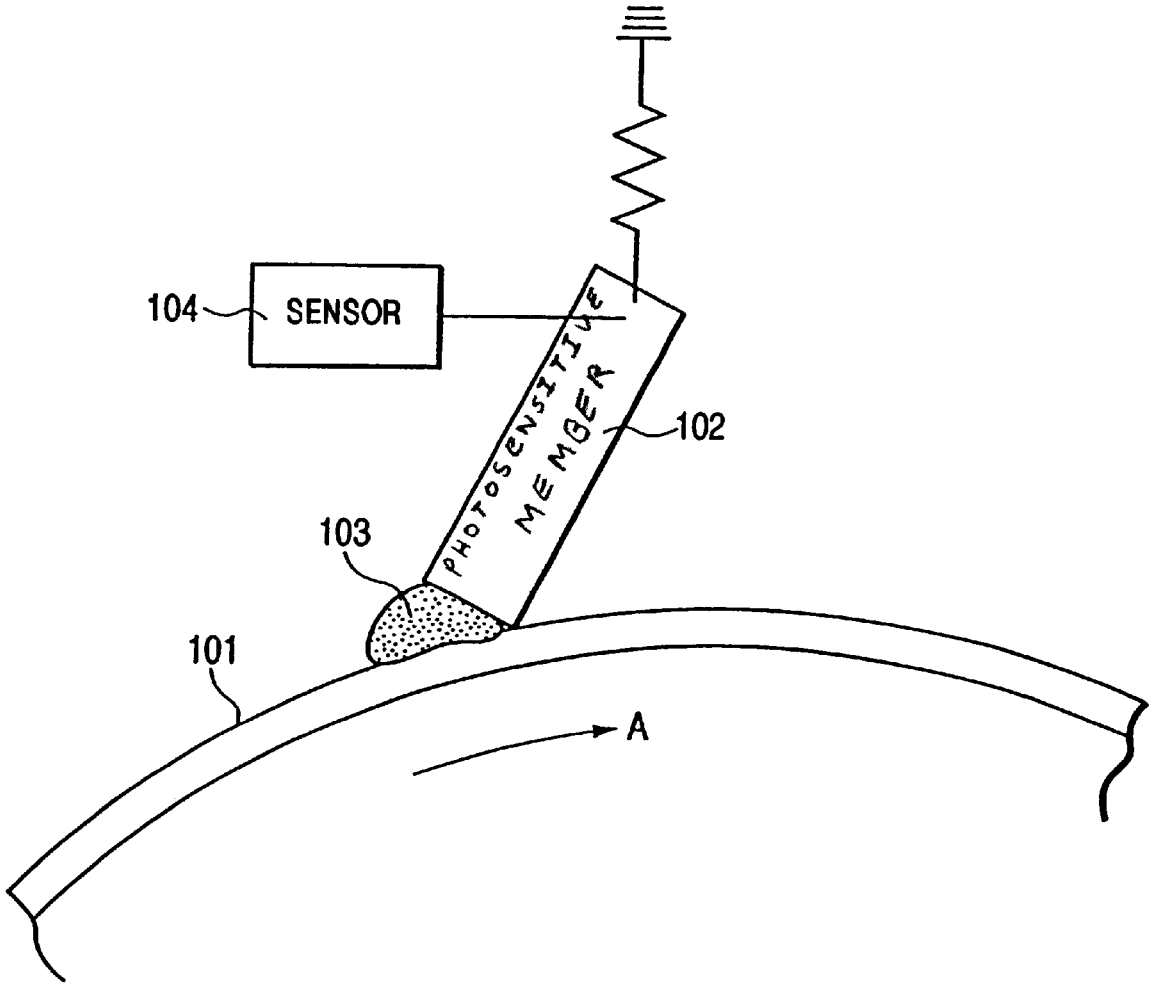
FIG. 1 is a schematic view of an evaluation system for determining the standard deviation of frictional force in its change with time.

FIG. 1 conceptionally illustrates an evaluation system for the above. In FIG. 1, reference numeral 101 denotes a surface layer of a photosensitive member; 102, a cleaning blade; and 103, how a toner stands during the cleaning. A sensor 104 is connected to the cleaning blade 102 to detect frictional force produced in microscopically short time.

The present inventors have examined standard deviation under various test conditions by using the evaluation system as shown in FIG. 1, and have ascertained that standard deviation correlates clearly with melt-adhesion proofness. It, however, has been found that the standard deviation depends inevitably on the linear pressure of blade that changes in accordance with copying processes and hence, stated more strictly, what is important is the slope of proportionality between linear pressure and standard deviation, i.e., the measure (amount) of standard deviation per 1 gf/cm of linear pressure applied to the blade.

More specifically, the frictional force and its standard deviation are examined in detail using the evaluation system as shown in FIG. 1 and while changing copying process conditions variously. As shown in FIG. 1, the toner 103 is fed between the photosensitive member surface layer 101 and the cleaning blade 102, and the photosensitive member is rotated in the direction of an arrow A at a constant speed (e.g., a rotational speed that may provide a process speed of 320 mm/sec). The frictional force applied to the blade is detected with the sensor 104. The blade is supported with a supporting rod (not shown), and is balanced by a weight (not shown) at a fulcrum. In that state, the load applied between the surface layer and the blade can be controlled by the weight. The load applied to the blade is expressed by a linear pressure obtained by dividing the weight of the blade by the length of the blade. The blade is changed for another every time the individual evaluation is made. As the toner, virgin toner is used on each occasion, taking care not to make external additives uneven.

Figure 2:
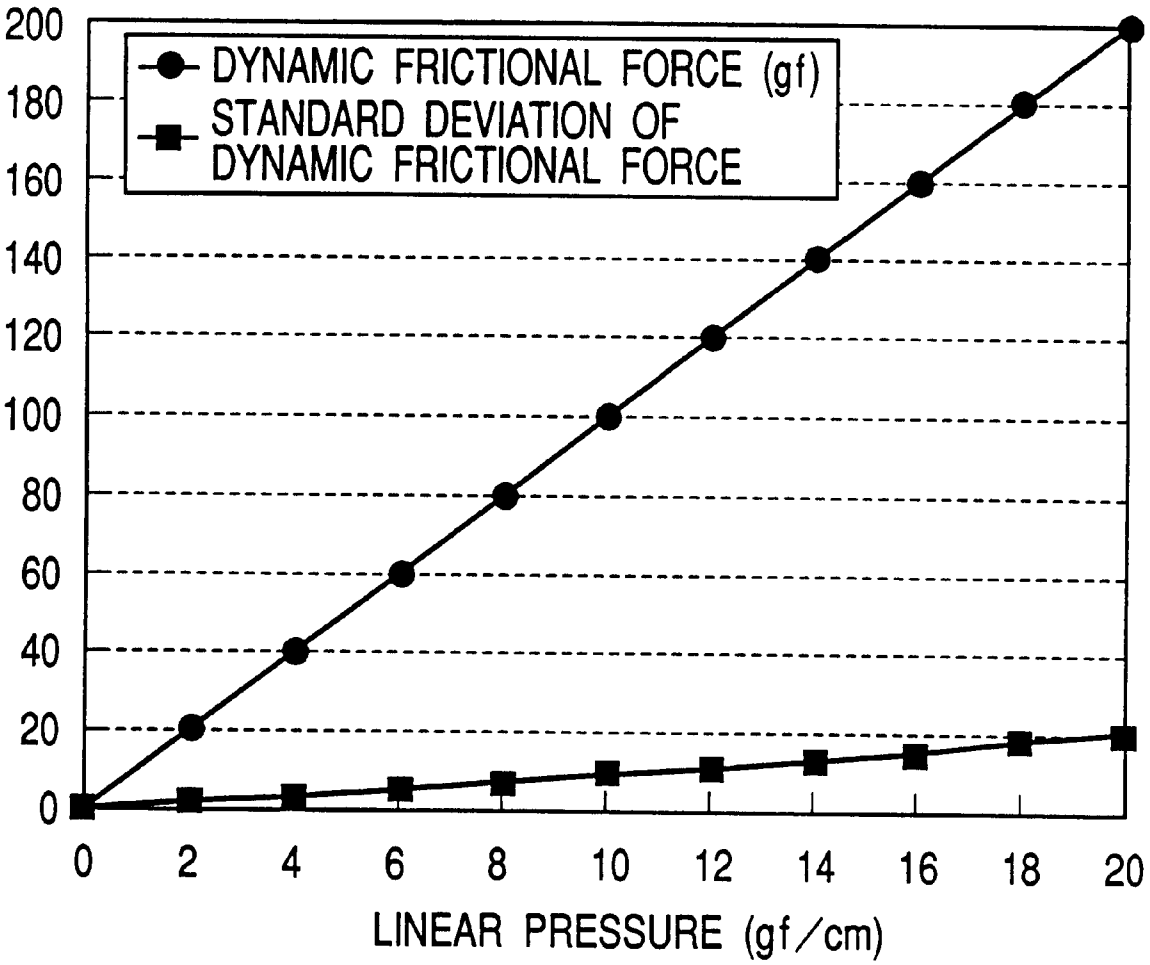
FIG. 2 is a graph showing an example of the relationship between linear pressure and dynamic frictional force and between the linear pressure and the standard deviation of dynamic frictional force.

Using this evaluation system, the frictional force and its standard deviation have been examined at various linear pressure to reveal that as shown in FIG. 2 there is a proportionality between the linear pressure and the standard deviation or dynamic friction and that the standard deviation or dynamic fricitional force increases with an increase in the linear pressure.

More specifically, it has been found that the value of standard deviation itself that changes depending on the changing of the linear pressure that depends on copying processes has no clear relation with the melt-adhesion. Accordingly, further detailed examination has been made to reveal that what reflects the melt-adhesion proofness is the slope of proportionality between linear pressure and standard deviation, i.e., the measure of standard deviation per 1 gf/cm of linear pressure applied to the blade.

Figure 3A:
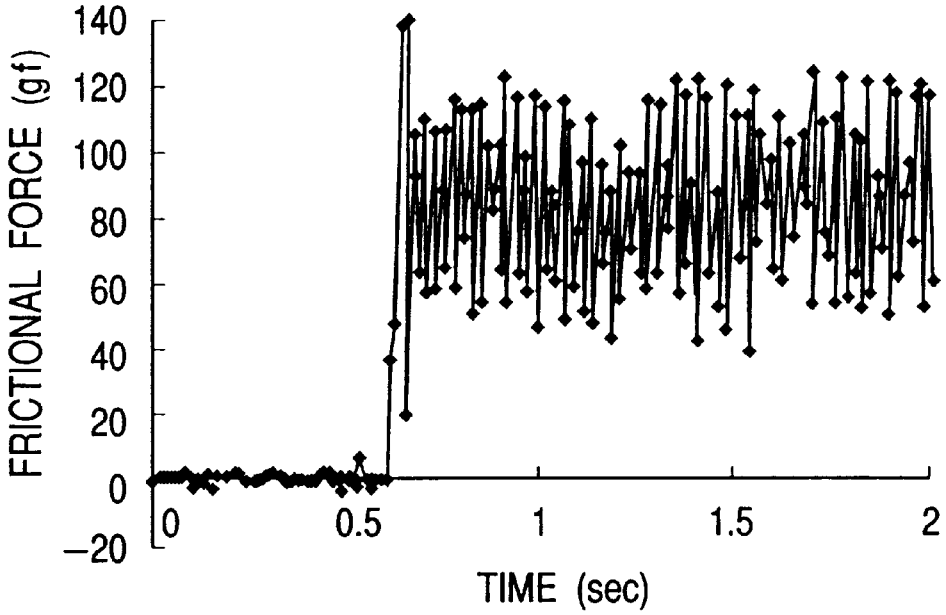
FIGS. 3A and 3B are graphs showing examples of change with time of frictional force.
Figure 3B:
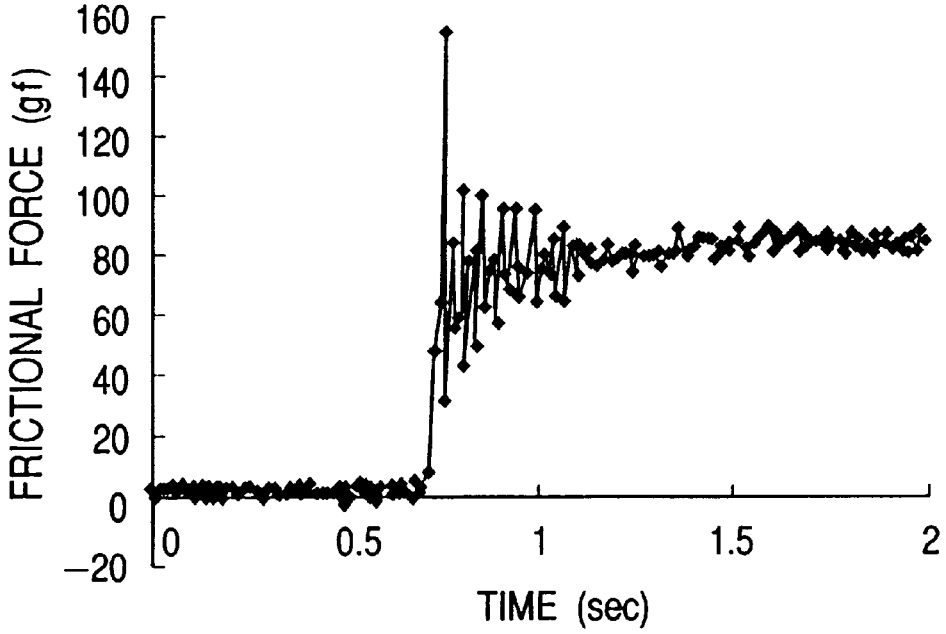

FIGS. 3A and 3B are graphs showing examples of change with time of frictional force, obtained by the above evaluation system. In this experiment, two types of photosensitive members (A and B) having different materials for the surface layer are used in the evaluation system shown in FIG. 1. A urethane blade is used as the blade, and the linear pressure applied to the blade is set at a value (14 gf/cm) usually used in copying machines. FIGS. 3A and 3B show that photosensitive members (drums) having been standing has started being rotated after 0.6 to 0.7 second. The greatly peaking part shows a maximum static frictional force between the photosensitive member (drum) and the blade which stand via a toner. Thereafter, the blade comes into a steady state while causing vibrations. Those at about 1 minute and thereafter as shown in FIGS. 3A and 3B correspond to the steady state.

Here, in FIGS. 3A and 3B showing the results obtained using the photosensitive members A and B, respectively, the average values of steady state, i.e., the dynamic frictional forces are substantially identical to each other but the values of standard deviation are greatly different from each other.

The standard deviation is a measure represented by the following expression (I).

$$\text{Standard deviation}=SQR[\{\Sigma(Xn-Xi)^2\}/n] \quad \text{(I)}$$

The photosensitive member A does not cause any faulty cleaning, but shows a value of standard deviation of as large as about 30 gf, which corresponds to about 2.15 gf when calculated in terms of 1 gf/cm of linear pressure. In a durability test made using a like photosensitive member (drum) and a blade made of a like material and using a copying machine having an equivalent layout, it has been found that the melt-adhesion tends to occur in an environment of low temperature/low humidity.

On the other hand, the photosensitive member B shows a standard deviation of as small as about 4 gf, which corresponds to about 0.29 gf when calculated in terms of 1 gf/cm of linear pressure. In a durability test made using a like combination and using a copying machine having an equivalent layout, neither melt-adhesion nor faulty cleaning has been found not to occur even in a severe environment.

A similar experiment has also been made using the photosensitive member B and setting the linear pressure so greatly that the standard deviation of dynamic frictional force come to be about 30 gf. Here, the linear pressure is 100 gf/cm, which corresponds to about 0.30 gf when calculated in terms of 1 gf/cm of linear pressure. As a result, in a test made using a like combination and using a copying machine having an equivalent layout, neither melt-adhesion nor faulty cleaning has been found to occur even in a severe environment.

From the result of these experiments and durability tests, it has been confirmed that, as the factor that may cause melt-adhesion, the matter is not so much susceptible to the magnitude of dynamic frictional force in a steady state but is rather concerned with the measure of standard deviation of dynamic frictional force.

Namely, the melt-adhesion can be prevented when the frictional force per unit linear pressure applied to the blade is so optimized that its standard deviation stands at a specific value or below.

It has also been found that a threshold value of melt-adhesion proofness resides in the measure of standard deviation per unit linear pressure rather than in the value of standard deviation itself that depends on the linear pressure.

Besides the results shown in FIGS. 3A and 3B, studies have also been made under various conditions. From the results of such studies, it has been found that the melt-adhesion proofness may change depending on the surface shape of the drum, control of values of physical properties, materials for the blade, linear pressure applied to the blade, toner materials, process speed and so forth but it is difficult to prevent the melt-adhesion without regard to environment only by changing these individually.

The melt-adhesion can be prevented without regard to environment, by controlling the respective conditions in combination so that the frictional force per unit linear pressure applied to the blade is so optimized that its standard deviation stands at a specific value or below.

The reason why the melt-adhesion can be prevented when the copying process is so optimized that the standard deviation of the frictional force applied to the blade is controlled within the range of the present invention has not still been elucidated entirely, and is roughly presumed as follows:

The standard deviation of frictional force represents the amplitude of microscopic vibration produced by friction. This vibration causes the edge of a blade to warp in a very small measure. When the blade is restored from this warpage, a strong compression may inevitably instantaneously act on the toner present in the vicinity of the blade edge. Usually, if the toner has once adhered because of this compression, it is scraped off by the blade. However, on the photosensitive member surface, there are, e.g., areas lying behind protrusions or behind microscopic concaves and convexes and areas from which the toner is not scraped off because of its chemical adsorption to dangling bonds. Such areas form microscopic convexes and hence further cause local microscopic vibration. Then, the compression applied to the toner present in the vicinity of the blade edge becomes locally greater, so that, because of repetition of such vicious circle, the toner sticks strongly to the photosensitive member surface, as so presumed.

On the other hand, when the microscopic vibration is in an amplitude not larger than a certain degree, it follows that the blade warps in a small measure, thus the compression applied to the toner present in the vicinity of the blade edge is considered also small when the blade warps and returns to the original state. More specifically, when the standard deviation of the frictional force per 1 gf/cm of linear pressure applied to the blade is 2 gf or less, it is considered that the blade warps in a very small measure and the compression applied is small and can not be a force sufficient for causing the toner to stick.

As an additional factor, the standard deviation of frictional force represents the amplitude of microscopic vibration produced by friction as stated above. This vibration causes the edge of a blade to turn up in a very small measure. When it occurs, the toner is brought in between the blade and the photosensitive member in a quantity larger than usual. Thereafter, when the edge returns to the original state by its own elasticity, a strong compression may inevitably instantaneously act on the toner held between the blade edge and the photosensitive member. Usually, if the toner has once adhered because of this compression, it is scraped off by the blade. However, on the photosensitive member surface, there are, e.g., areas lying behind protrusions or behind microscopic concaves and convexes and areas from which the toner is not scraped off because of its chemical adsorption to dangling bonds. Such areas form microscopic convexes and hence further cause local microscopic vibration. Then, the compression applied to the toner held between the blade and the photosensitive member becomes locally greater, so that, because of repetition of such vicious circle, the toner sticks strongly to the photosensitive member surface, as so presumed.

On the other hand, when the microscopic vibration is in an amplitude not larger than a certain degree, it follows that the blade turns up in a small measure, thus the toner brought in between the blade and the photosensitive member can be in a small quantity, and the compression caused by rebound is considered also small. More specifically, when the standard deviation of the frictional force per 1 gf/cm of linear pressure applied to the blade is 2 gf or less, it is considered that the blade turns up in a smaller measure than the average particle diameter of the toner or in a not so large measure and hence the toner may be brought in the gap with difficulty. Also, the compression caused by rebound is considered proportional to the measure of blade turn-up, and hence the compression can not be a force sufficient for causing the toner to stick.

An example of an image-forming process of an image-forming apparatus employing electrophotography (an electrophotographic apparatus) will be described with reference to FIG. 4.

Figure 4:
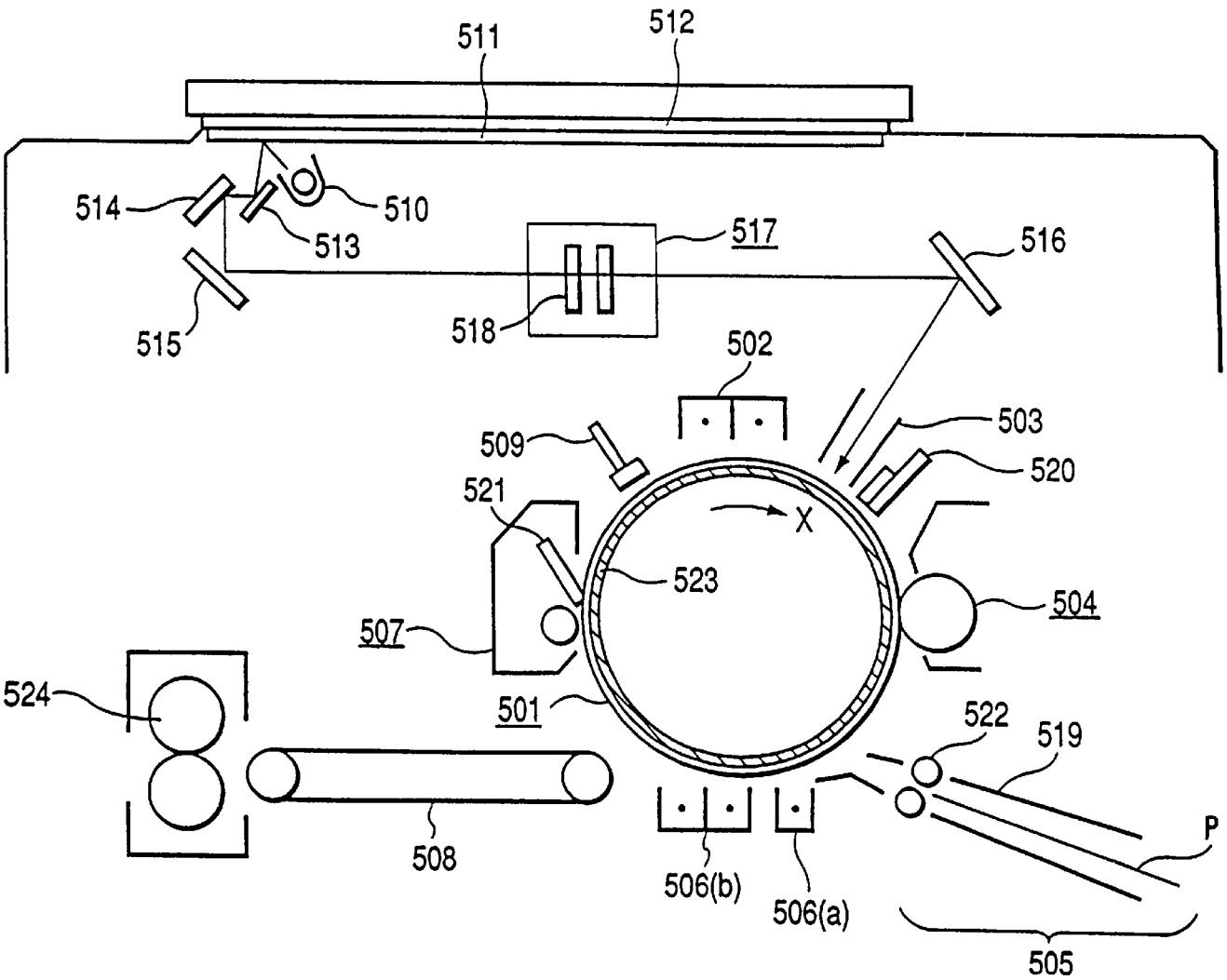
FIG. 4 is a diagrammatic illustration showing an example of an image-forming apparatus employing electrophotography.

FIG. 4 is a diagrammatic illustration showing an example of the construction of an image-forming apparatus employing electrophotography. A photosensitive member 501 is rotated in the direction of an arrow X. Around the photosensitive member 501, a primary charging assembly 502, an electrostatic latent image forming portion 503, a developing assembly 504, a transfer paper feed system 505, a transfer charging assembly 506(*a*), a separation charging assembly 506(*b*), a cleaner 507, a transport system 508 and a charge elimination light source 509 are provided clockwise.

In the above image-forming process, with regard to process speed, the present invention can basically be effective in any range. The present invention can be most effective when the process speed is set within a range of preferably 200 mm/sec or above, and more preferably 300 mm/sec or above. If the process speed is lower than 200 mm/sec, the elastic energy accumulated is not released at one time but liberated stepwise gradually when the blade having deformed returns to the original state by rebound, resulting in a small standard deviation apparently in some cases.

In fact, the measurement made by the evaluation system shown in FIG. 1 has brought about a condition that the return by rebound is considered to have occurred stepwise when the process speed is lower than 200 mm/sec. Accordingly, there is a possibility that the mechanism as presumed above can not be applicable when the process speed is lower than a certain level. In a durability test made using an actual copying machine, it has also been found that the present invention can be most effective when the process speed is set within a range of 200 mm/sec or above, and more effectively 300 mm/sec or above.

Meanwhile, with regard to its upper limit, the process speed may preferably be set in a range of 600 mm/sec or below in order to make the present invention most effective. If the process speed is higher than 600 mm/sec, the kinetic energy of toner with respect to the cleaning blade is relatively so great that any microscopic heat generation due to friction may contribute greatly, to make the toner tend to melt. This contribution by frictional heat is a different factor which can not be explained by the mechanism used in the present invention, and hence this is not taken into account in the present invention.

With regard to the hardness of the cleaning blade, too, when considered similarly, the present invention can basically be effective in any range. However, a hardness set within a certain range is considered better for making the present invention most effective. If the cleaning blade is too soft, the faulty cleaning can not be avoided unless the linear pressure is set extremely high, and a large amplitude of vibration may result because of a high linear pressure, thus this is not so practical. If on the other hand the cleaning blade is too hard, its elastic deformation is so small as to cause it to break as a result of long-term service, tending to cause uneven scrape of the photosensitive member, thus this is not practical. Accordingly, with regard to the hardness of the cleaning blade, too, it is considered that the present invention can be most effective when the hardness is within a practical range, i.e., preferably from 60 degrees to 80 degrees, and more preferably from 70 degrees to 80 degrees, as JIS hardness.

The hardness (Hs) of the cleaning blade is a value measured in the following way: A press face having a plane vertical to an indenter point and having a hole through which the indenter point is passed is brought into contact with the surface of a test piece, and the distance at which the indenter point protruding from the hole made at the center of the press face, upon application of a spring pressure, is forced back by the test piece is measured as hardness. This is measured and expressed in the manner prescribed in Japanese Industrial Standard JIS K-6301.

Incidentally, the indenter point has a tip rounded by 0.79±0.02 in diameter.

With regard to the average particle diameter of the toner, basically there are no particular limitations on it, but those having an average particle diameter smaller than a certain value are preferred. If the toner has a large average particle diameter, less toner particles are brought in between the blade and the photosensitive member, and hence a factor other than the mechanism as presumed above, e.g., movement as if the blade drags the toner, is considered to intervene between them inevitably. As a range most suitably applicable to the above mechanism, i.e., to the present invention, the average particle diameter may preferably be not larger than 8 $\mu$m.

The photosensitive member used in the image-forming apparatus of the present invention may be any photosensitive member so long as it is constituted of a non-single-crystal material mainly composed of silicon atoms at least. A photosensitive member on which a surface layer has been formed is preferred.

As this surface layer, preferably usable is a layer formed using an inorganic material produced by a plasma process making use of glow discharge.

The surface layer of the photosensitive member, which is formed using the inorganic material produced by a plasma process making use of glow discharge, has a surface shape with relatively gentle unevenness, and this is considered to act advantageously to control the standard deviation and prevent the melt-adhesion. Since the surface unevenness may cause initial formation of melt-adhesion, one may think to remove it by abrasion to prevent further melt-adhesion. Such a method, however, can not remove dangling bonds, i.e., the part tending to adsorb substances, and conversely such part tending to adsorb substances may be formed in a large number, where any adsorbed substance may make the friction greater, showing a tendency that the standard deviation of frictional force becomes greater with progress of running. On the other hand, the formation of the surface layer in such a way that the part tending to adsorb substances is not formed while controlling surface unevenness is considered to lower the friction to make the microscopic vibration more hardly occur.

Moreover, the inorganic type surface layer formed on the surface of the photosensitive member has a higher surface hardness, may more hardly undergo uneven scrape and has a lower coefficient of friction of the surface than organic type photosensitive members. Hence, the freedom of designing can be made greater when viewed from the photosensitive member and the cleaning mechanism in total.

For example, a non-single-crystal silicon carbide film containing at least silicon atoms and carbon atoms has a high hardness and also a high transparency as well as a good surface flatness, and may preferably be used. Also, especially when a non-single-crystal carbon film formed using a hydrogen carbide gas is used as the surface layer, it has so higher a hardness as to be tough to scrape, a low coefficient of friction and a better surface flatness, and hence may most preferably be used.

As another example, when a non-single-crystal carbon film containing at least fluorine as the surface layer, the slip properties of the surface can greatly be improved and, compared with surface layers formed using other materials, the freedom of cleaning mechanism can be broadened to obtain an equivalent effect. More specifically, the toner can be released from the photosensitive member surface with ease, and the contact pressure of the cleaning blade can be set smaller, so that the service life of the cleaning blade and the service life of the photosensitive member can be made longer and also the freedom of blade materials can greatly be broadened.

Figure 5A:
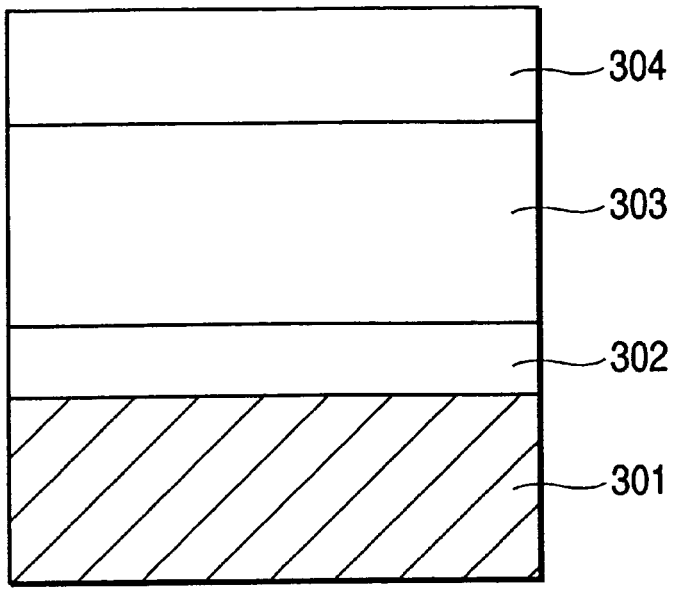
FIGS. 5A and 5B are diagrammatic cross-sectional views showing examples of the electrophotographic photosensitive member.
Figure 5B:
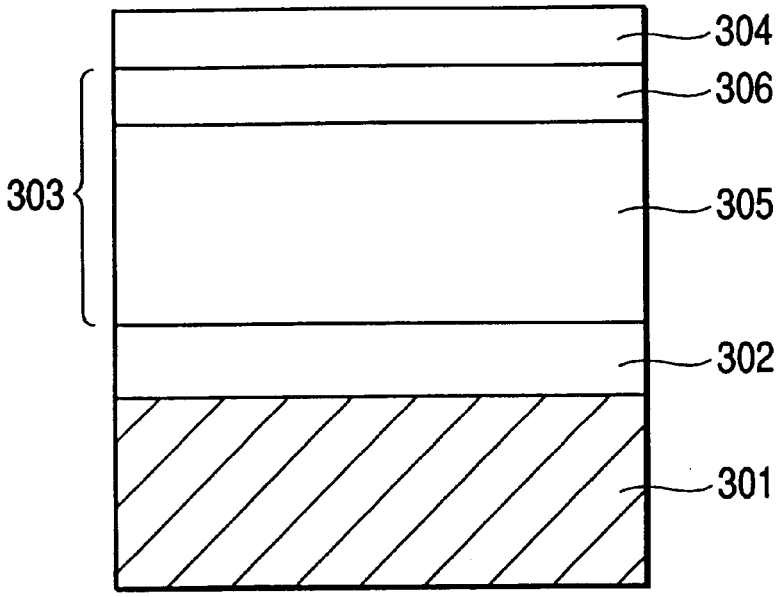

FIGS. 5A and 5B are diagrammatic cross-sectional views showing examples of electrophotographic photosensitive members preferably usable in the present invention.

FIG. 5A shows a photosensitive member called a single-layer type, having a photoconductive layer not functionally separated, which comprises a substrate 301 and superposed thereon a charge injection blocking layer 302 and a photoconductive layer 303 formed of a non-single-crystal material mainly composed of silicon atoms at least. A surface layer 304 formed of non-single-crystal material may optionally be superposed thereon.

FIG. 5B illustrates a photosensitive member called a function-separated type since a photoconductive layer is functionally separated into the two, a charge generation layer and a charge transport layer. This comprises a substrate 301 and a charge injection blocking layer 302 optionally formed on the substrate, and deposited thereon a photoconductive layer 303 functionally separated into a charge transport layer 305 and a charge generation layer 306, formed of non-single-crystal material mainly composed of silicon atoms at least. A surface layer 304 formed of a non-single-crystal material may optionally be superposed thereon. Here, the charge transport layer 305 and the charge generation layer 306 may be used in any positional relationship. When the separation of functions is made by compositional change, the compositional change may be made continuous.

In the photosensitive members shown in FIGS. 5A and 5B, the respective layers may involve continuous compositional changes and may have no clear interfaces between them. The charge injection blocking layer 302 and the surface layer 304 may be omitted as occasion calls. Between the photoconductive layer 303 and the surface layer 304 formed of a non-single-crystal material, an intermediate layer may also optionally be provided for the purpose of improving adhesion. Materials for the intermediate layer may include materials providing composition intermediate between the photoconductive layer 303 and the surface layer 304. Alternatively, SiC, SiO or SiN may be used. The intermediate layer may have composition continuously changed.

To form the surface layer 304 formed of a non-single-crystal material, a non-single-crystal silicon carbide hydride represented by a-$Si_xX_{1-x}$:H may preferably be used. Appropriate selection of the value of x can optimize the film hardness, transparency, surface smoothness and so forth.

The use of non-single-crystal carbon in the surface layer 304 is more preferred in view of hardness, durability, low frictional properties and flatness. The non-single-crystal carbon herein referred to may chiefly indicate amorphous carbon having properties intermediate between graphite and diamond. It may be microcrystalline or polycrystalline in part. The film may also appropriately contain hydrogen atoms. This enables control of the adhesion, transparency and flatness of the film.

The surface layer 304 may preferably be a non-single-crystal carbon film containing at least fluorine. Here, the fluorine may be in a content of from 5 to 50% by weight, and preferably from 10 to 40% by weight, as F/(F+C).

These films can be formed by sputtering or ion implantation. Films formed by plasma CVD have both a high transparency and a high hardness, and are most preferable for their use as surface layers of electrophotographic photosensitive members.

As electric-discharge frequencies used in the plasma CVD used when such non-single-crystal silicon carbide hydride or non-single-crystal carbon films are formed, any frequencies may be used. In an industrial scale, high frequencies of from 1 to 450 MHz, called RF or VHF frequency bands, in particular, 13.56 MHz, may preferably be used. Especially when high frequencies of frequency bands called VHF, of from 50 to 450 MHz, are used, the films can be formed in both a higher transparency and a higher hardness, and are more preferable when used as surface layers.

Figure 6:
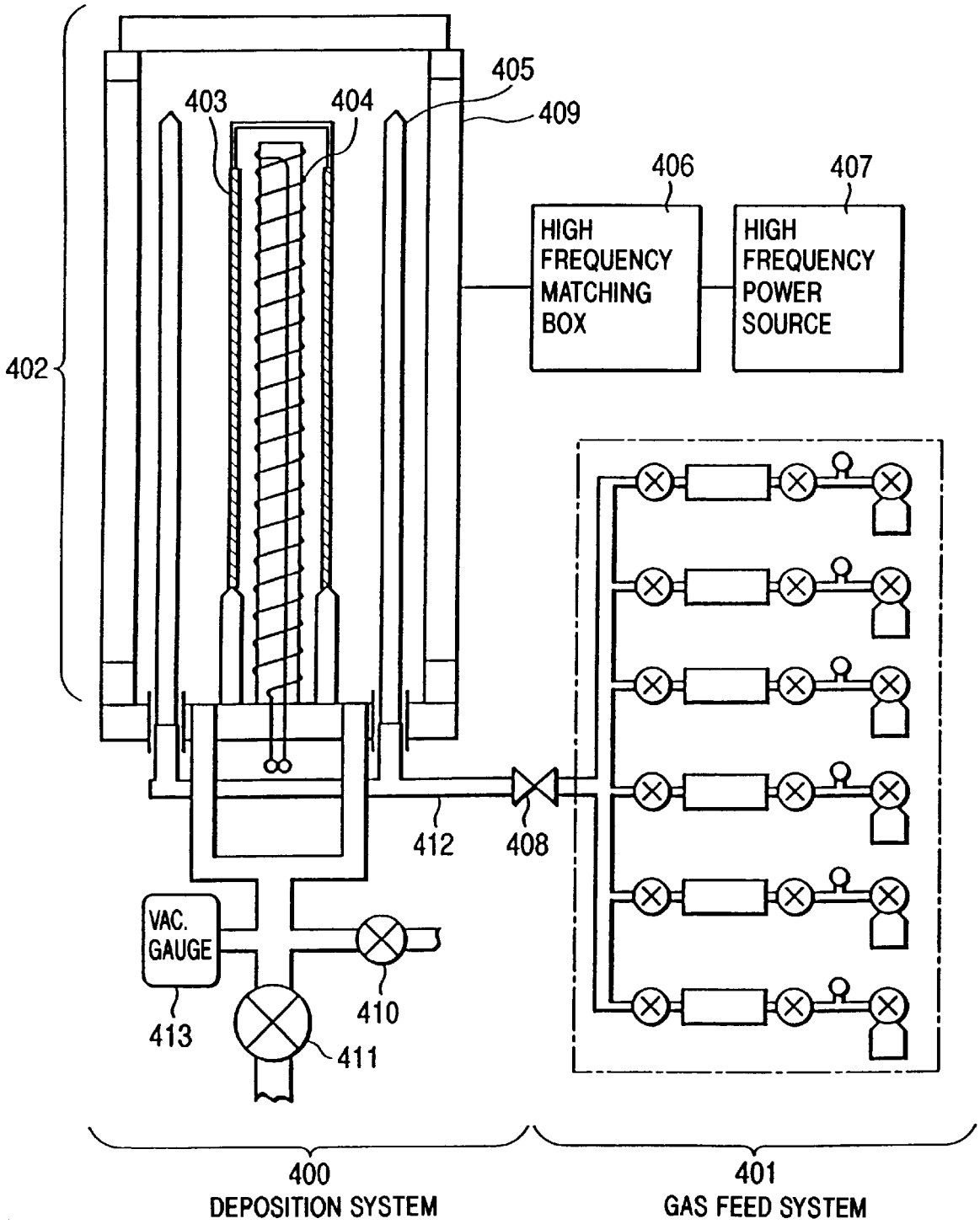
FIG. 6 is a system for forming deposited films by plasma CVD (chemical vapor deposition) which system can be used in the production of the electrophotographic photosensitive member.

FIG. 6 is a diagrammatic view showing an example of a deposition system for producing a photosensitive member by plasma CVD using a high-frequency power source according to the present invention.

Stated roughly, the system is constituted of a deposition system 400, a material gas feed system 401 and an exhaust system (not shown) for evacuating the inside of a reactor 402. In the reactor 402 in the deposition system 400, a film-forming target cylindrical substrate 403 connected to a ground, a heater 404 for heating the film-forming target cylindrical substrate 403, and a material gas feed pipe 405 are provided. A high-frequency power source 407 is also connected to the reactor via a high-frequency matching box 406.

The material gas feed system 401 is constituted of gas cylinders for material gases and etching gases, such as $SiH_4$, $H_2$, $CH_4$, NO, $B_2H_6$, $CF_4$ and $F_2$, valves and mass flow controllers. The gas cylinders for the respective component gases are connected to the gas feed pipe 405 in the reactor 402 through a valve 408.

The high-frequency power source used in the present invention may have any output power so long as it can output an electric power within the range of from 10 W to 5,000 W or higher, suited for systems used. With regard to the degree of output variability of the high-frequency power source, there are no particular limitations.

As the high-frequency matching box 406 used, those having any constitution may preferably be used so long as they can make matching between the high-frequency power source 407 and load. As methods for the matching, it may preferably automatically be controlled, or may manually be controlled without any adverse effect on the present invention at all.

As materials for a cathode electrode 409 to which the high-frequency power is to be applied, usable are copper, aluminum, gold, silver, platinum, lead, nickel, cobalt, iron, chromium, molybdenum, titanium, stainless steel, and composite materials of two or more of these materials. The cathode electrode may preferably have a cylindrical shape, and may have an oval shape or a polygonal shape as occasion calls.

The cathode electrode 409 may optionally be provided with a cooling means. As a specific cooling means, the electrode may be cooled with water, air, liquid nitrogen or Peltier devices, which may be selected as occasion calls.

The film-forming target cylindrical substrate 403 used in the present invention may be made of any material and may have any shape in accordance with its uses. For example, with regard to its shape, it may preferably be cylindrical when electrophotographic photosensitive members are produced, or may have the shape of a flat plate or any other shape as occasion calls. With regard to its material, usable are copper, aluminum, gold, silver, platinum, lead, nickel, cobalt, iron, chromium, molybdenum, titanium, stainless steel, and composite materials of two or more of these materials, as well as insulating materials such as polyester, polyethylene, polycarbonate, cellulose acetate, polypropylene, polyvinyl chloride, polyvinylidene chloride, polystyrene, glass, quartz, ceramics and paper which are coated with conductive materials.

As for its surface shape, unevenness made by cutting with a cutting tool or by dimple embossing may be used in combination for the purpose of preventing interference of light.

An example of the procedure for forming the photosensitive member by the use of the system shown in FIG. 6 will be described below.

The film-forming target cylindrical substrate 403 is set in the reactor 402, and the inside of the reactor 402 is evacuated by means of a diffusion pump (not shown). Subsequently, the temperature of the film-forming target cylindrical substrate 403 is controlled at a prescribed temperature of from 20 to 500° C. by means of the heater 404 for heating the film-forming target cylindrical substrate.

Before material gases for forming the photosensitive member are flowed into the reactor 402, gas cylinder valves and a leak valve 410 of the reactor are checked to make sure that they are closed, and also valves in the gas feed system 401 other than gas cylinders are checked to make sure that they are opened. Then, a main valve 411 is opened to evacuate the insides of the reactor 402 and a gas feed pipe 412.

Next, at the time a vacuum gauge 413 has been read to indicate a pressure of $5\times10^{-4}$ Pa, the auxiliary valve 408 is closed. Thereafter, valves are opened so that gases are respectively introduced from gas cylinders, and each gas is controlled to have a pressure of 2 kg/cm$^2$ (0.2 MPa) by operating pressure controllers. Next, flow-in valves are slowly opened so that gases are introduced into mass flow controllers.

After the film formation is thus ready to start through the above procedure, the photoconductive layer is formed on the film-forming target cylindrical substrate 403.

At the time the film-forming target cylindrical substrate 403 has had a prescribed temperature, some necessary valves among the respective valves are slowly opened so that prescribed material gases are fed into the reactor 402 from the gas cylinders through the gas feed pipe 405. Next, the mass flow controllers are operated so that each material gas is adjusted to flow at a prescribed rate. In that course, the divergence of the main valve 411 is so adjusted that the pressure inside the reactor 402 comes to be a prescribed pressure of not higher than 133 Pa while watching a vacuum gauge 413.

At the time the internal pressure has become stable, a high-frequency power source 407 is set at a desired electric power, and a high-frequency power is supplied to the cathode electrode 409 through the high-frequency matching box 406 to cause high-frequency glow discharge to take place. The material gases fed into the reactor 402 are decomposed by the discharge energy thus produced, so that a prescribed deposited film mainly composed of silicon is formed on the film-forming target cylindrical substrate 403. After a film with a desired thickness has been formed, the supply of high-frequency power is stopped, and flow-out valves are closed to stop material gases from flowing into the reactor 402. Thus, the formation of the photoconductive layer is completed.

In the course the films are formed, the film-forming target cylindrical substrate 403 may be rotated at a prescribed speed by means of a drive (not shown).

The image forming process will specifically be described below with reference to FIG. 4.

The photosensitive member 501 is uniformly electrostatically charged by means of the primary charging assembly 502, to which a high voltage stands applied. Light emitted from a lamp 510 reflects from an original 512 placed on an original glass plate 511 and passes through mirrors 513, 514 and 515, and through a lens 518 of a lens unit 517 an image is formed on the photosensitive member at its electrostatic latent image forming portion, which is then guided through a mirror 516 and projected as light that carries information, so that an electrostatic latent image is formed on the photosensitive member 501. To this latent image, a toner with a negative polarity is fed from the developing assembly 504.

Meanwhile, a transfer medium P is passed through a transfer medium feed system 505 and is fed in the direction of the photosensitive member 501 while adjusting its leading part feed timing by means of resist rollers 522. A positive electric field, having a polarity reverse to that of the toner, is imparted to the transfer medium P on the back thereof at the gap between the transfer charging assembly 506(*a*), to which a high voltage is applied, and the surface of the photosensitive member 501. As a result, the negative-polarity toner image formed on the surface of the photosensitive member is transferred to the transfer medium P.

Next, the transfer medium P is separated from the photosensitive member 501 by means of the separation charging assembly 506(*b*), to which an AC voltage with a high voltage is applied, and then passed through the transfer medium transport system 508 to reach a fixing assembly 524, where the toner image is fixed, and the transfer medium P with the fixed image is delivered out of the apparatus.

The toner remaining on the photosensitive member 501 is collected by a magnet roller and a cleaning blade 521 of a cleaning unit 507, and the remaining electrostatic latent image is erased by exposure to light from the charge elimination light source 509.

EXAMPLES

The present invention will be described below in greater detail by giving test examples and working examples. The present invention is by no means limited by these.

Example 1

Using the plasma CVD system shown in FIG. 6, a charge injection blocking layer (lower layer) and a photoconductive layer were deposited on a cylindrical aluminum substrate under conditions shown in Table 1. Three photosensitive drums were produced in this way, and were each used one by one in the evaluation tests described later.

Similarly, a charge injection blocking layer (lower layer) and a photoconductive layer were deposited under conditions shown in Table 1, and thereafter non-single-crystal carbon hydride was deposited thereon in a thickness of 5,000 angstroms under conditions shown in Table 2 to form a surface layer. Three photosensitive drums were produced in this way, and were evaluated similarly.

Similarly, a charge injection blocking layer (lower layer) and a photoconductive layer were deposited under conditions shown in Table 1, and thereafter non-single-crystal silicon hydride carbide was deposited thereon in a thickness of 5,000 angstroms under conditions shown in Table 3 to form a surface layer. Three photosensitive drums were produced in this way, and were evaluated similarly.

As process conditions under which the above three kinds of photosensitive drums were used, an elastic rubber blade having a JIS hardness of 65 degrees was used, process speed was set at 420 mm/sec, and a toner having an average particle diameter of 6.5 $\mu$m was used.

First, the standard deviation of frictional force in its change with time was determined by the use of the evaluation system shown in FIG. 1. The standard deviation per 1 gf/cm of linear pressure applied to the blade was 1.4 gf, 1.7 gf and 1.9 gf in respect of the drum having the non-single-crystal carbon hydride surface layer, the drum having the non-single-crystal silicon carbide hydride surface layer and the drum having no surface layer, respectively.

Using the above photosensitive members (drums) and under the above conditions, evaluation tests were made in the following way.

(1) Toner Melt-Adhesion Evaluation Test

Each photosensitive drum produced was set in a modified machine of a copying machine NP6060, manufactured by CANON INC., modified for test purpose, and the above process conditions were applied. Using a drum heater to provide conditions severe to melt-adhesion (conditions easily causative of melt-adhesion), the drum was heated to a temperature higher than usual. The drum surface temperature was set at 50° C., and a durability test was made using an original with area percentage of 1% (an original on which only straight lines were drawn in the diagonal direction of an A4-size sheet).

Every time the running on 1,000 sheets was completed, a halftone image was copied to examine whether or not any melt-adhesion occurred. Such a durability test was made on up to 100,000 sheets at maximum to make evaluation by the ordinal number of sheet on which the melt-adhesion occurred.

(2) Cleaning Performance Evaluation Test

A cleaning performance evaluation test was made using the modified machine of NP6060. A durability test was made on 100,000 using an entirely black (hereinafter "solid-black") original. After the durability test, a halftone image was copied to examine whether or not any faulty cleaning occurred.

Stated specifically, a region parallel to the direction of a generatrix of the drum was taken in an A4-size halftone image, and the area contaminated by faulty cleaning was estimated from five sheets of copy samples. Similar evaluation was made five times to obtain results in respect of the five sheets of copy samples.

(3) Uneven-Scrape Evaluation Test

Durability to scrape upon long-term service was examined using the modified machine of NP6060. To provide conditions under which uneven scrape tends to occur, a small particle size toner was used and also an original with stripes drawn in parallel to the peripheral direction of the photosensitive drum was used to take copies on 100,000 sheets in such a way that the same part was always rubbed by the small particle size toner having a high rubbing force.

Subsequently, after the influence of ghost was removed, a halftone original was copied to examine whether or not any uneven density occurred. After the uneven density was checked, a potentiometer was inserted to the part positioned at the developing assembly, and the potential at the part corresponding to black and white of the stripes was examined to measure its potential difference.

The greater the potential difference is, the more it indicates that the density is uneven. This evaluation was made on five sheets of halftone copy samples and by potential measurement made five times.

These evaluation results indicate that, the smaller the values are, the better. For comparison, the results are expressed as relative values assuming as 50 the evaluation results of Comparative Example 1 given later, and standardized into values of from 0 to 100.

The results of the foregoing are shown in Table 4 together with the results of Comparative Example 1. In the table, the mark "AA" represents 0 to 20 (very good properties); "A", 20 to 40 (good properties); "B", 40 to 60 (properties equivalent to Comparative Example 1); and "C", 60 to 100 (having a possibility of problems in practical use.)

Comparative Example 1

Using the plasma CVD system shown in FIG. 6, a charge injection blocking layer (lower layer) and a photoconductive layer were deposited on a cylindrical aluminum substrate under conditions shown in Table 1. The surface layer was not formed. Three photosensitive drums were produced in this way, and were each used one by one in the evaluation tests described above.

Process conditions were the same as those in Example 1 except that the cleaning blade had a hardness of 60 degrees. Here, in the measurement using the evaluation system shown in FIG. 1, the standard deviation per 1 gf/cm of linear pressure applied to the blade was 2.2 gf.

Using the above photosensitive drums and under the above conditions, evaluation tests were made in the same manner as in Example 1. The results are shown in Table 4 together with the results of Example 1.

In Example 1, any melt-adhesion greater than 0.3 mm little occurred even in the melt-adhesion test set under the conditions easily causative of melt-adhesion and even in the durability test made on 100,000 sheets set as the maximum number of sheets. Also, any faulty cleaning did not occur. Uneven scrape occurred slightly on the photosensitive drums having no surface layer, but it did not occur at all on the drums having the surface layer.

On the other hand, in Comparative Example 1, the melt-adhesion was seen to occur on about 3,000th sheet and subsequent sheets in the melt-adhesion test. In the test on cleaning performance, too, what is called blade shake (vibration in a large amplitude) occurred at the stage of tens of thousands of sheets to have caused faulty cleaning. Also, uneven scrape also occurred slightly.

As can be seen from the foregoing results, the present invention can be effective in the copying process in which the frictional force per 1 gf/cm of linear pressure applied to the blade is so optimized that its standard deviation in its change with time is 2 gf or below. As can also be seen therefrom, the present invention can more preferably be effective when the photosensitive drum having a surface layer is used.

Example 2

Using the plasma CVD system shown in FIG. 6, a charge injection blocking layer (lower layer) and a photoconductive layer were deposited on a cylindrical aluminum substrate under conditions shown in Table 1. Thereafter, non-single-crystal carbon hydride was deposited thereon in a thickness of 5,000 angstroms under conditions shown in Table 5 to form a surface layer, thus photosensitive drums were produced.

As process conditions under which the above photosensitive drums were used, an elastic rubber blade having a JIS hardness of 78 degrees was used, process speed was set at 120, 200, 400 and 600 mm/sec each, and a toner having an average particle diameter of 6.5 $\mu$m was used.

First, the standard deviation of frictional force in its change with time was determined by the use of the evaluation system shown in FIG. 1. The standard deviation per 1 gf/cm of linear pressure applied to the blade was 1.75 gf, 0.75 gf, 0.82 gf and 1.5 gf in respect of the process speed 120, 200, 400 and 600 mm/sec, respectively.

Using the above photosensitive drums and under the above conditions, evaluation was made in the same manner as in Example 1. The results are shown in Table 6.

In Example 2, any melt-adhesion greater than 0.3 mm little occurred, and neither faulty cleaning nor uneven scrape occurred at all. It was found that process speed of from 200 to 600 mm/sec was more desirable.

Example 3

Using the plasma CVD system shown in FIG. 6, a charge injection blocking layer (lower layer) and a photoconductive layer were deposited on a cylindrical aluminum substrate under conditions shown in Table 1. Thereafter, non-single-crystal carbon hydride was deposited thereon in a thickness of 5,000 angstroms under conditions shown in Table 7 to form a surface layer, thus photosensitive drums were produced.

As process conditions under which the above photosensitive drums were used, an elastic rubber blade having a JIS hardness of 58, 60, 70, 80 and 82 degrees each was used, process speed was set at 380 mm/sec, and a toner having an average particle diameter of 6.5 $\mu$m was used.

First, the standard deviation of frictional force in its change with time was determined by the use of the evaluation system shown in FIG. 1. From its value, the process conditions were checked to have been optimized. The standard deviation per 1 gf/cm of linear pressure applied to the blade was 1.8 gf, 1.7 gf, 1.1 gf and 1.57 gf in respect of the blade hardness 58, 60, 70, 80 and 82 degrees, respectively.

Using the above photosensitive drums and under the above conditions, evaluation was made in the same manner as in Example 1. The results are shown in Table 8.

In Example 3, any melt-adhesion greater than 0.3 mm little occurred, and neither faulty cleaning nor uneven scrape occurred at all. It was found that blade hardness of from 60 to 80 degrees was more desirable.

Example 4

Using the plasma CVD system shown in FIG. 6, a charge injection blocking layer (lower layer) and a photoconductive layer were deposited on a cylindrical aluminum substrate under conditions shown in Table 1. Thereafter, non-single-crystal carbon hydride was deposited thereon in a thickness of 5,000 angstroms under conditions shown in Table 5 to form a surface layer, thus photosensitive drums were produced.

As process conditions under which the above photosensitive drums were used, an elastic rubber blade having a JIS hardness of 72 degrees was used, process speed was set at 420 mm/sec, and a toner having an average particle diameter of 5, 6, 7, 8 and 9 $\mu$m each was used.

First, the standard deviation of frictional force in its change with time was determined by the use of the evaluation system shown in FIG. 1. From its value, the process conditions were checked to have been optimized. The standard deviation per 1 gf/cm of linear pressure applied to the blade was 1.6 gf, 1.4 gf, 1.0 gf, 1.5 gf and 1.9 gf in respect of the toner's average particle diameter 5, 6, 7, 8 and 9 $\mu$m, respectively.

Using the above photosensitive drums and under the above conditions, evaluation was made in the same manner as in Example 1. The results are shown in Table 9.

In Example 4, any melt-adhesion greater than 0.3 mm little occurred, and neither faulty cleaning nor uneven scrape occurred at all. It was found that the use of toner having an average particle diameter of 8 $\mu$m or smaller was more desirable.

Example 5

Using the plasma CVD system shown in FIG. 6, a charge injection blocking layer (lower layer) and a photoconductive layer were deposited on a cylindrical aluminum substrate under conditions shown in Table 1. Thereafter, in order to examine the influence of plasma CVD on the photosensitive drum surface, non-single-crystal carbon hydride was deposited thereon at a frequency of high-frequency power changed variously and under conditions shown in Table 10 to form a surface layer, thus photosensitive drums were produced. The frequency of high-frequency power was changed to be 13.56, 50, 105, 250 and 450 MHz.

As process conditions under which the above photosensitive drums were used, an elastic rubber blade having a JIS hardness of 76 degrees was used, process speed was set at 320 mm/sec, and a toner having an average particle diameter of 6.5 $\mu$m was used.

First, the standard deviation of frictional force in its change with time was determined by the use of the evaluation system shown in FIG. 1. From its value, the process conditions were checked to have been optimized. The standard deviation per 1 gf/cm of linear pressure applied to the blade was from 0.7 to 1.1 gf.

Using the above photosensitive drums and under the above conditions, evaluation was made in the same manner as in Example 1. The results are shown in Table 11. As can be seen from the results, the present invention can be effective at any frequency used as the high frequency in the plasma process to form the surface layer of the photosensitive drum.

Example 6

Using the plasma CVD system shown in FIG. 6, a charge injection blocking layer (lower layer) and a photoconductive layer were deposited on a cylindrical aluminum substrate under conditions shown in Table 12. Thereafter, a surface layer comprised of a-C:F was deposited thereon in a thickness of 5,000 angstroms under conditions shown in Table 13, thus photosensitive drums were produced.

As process conditions under which the above photosensitive drums were used, an elastic rubber blade having a JIS hardness of 71 and 74 degrees each was used, process speed was set at 400 mm/sec, and a toner having an average particle diameter of 6.5 $\mu$m was used.

First, the standard deviation of frictional force in its change with time was determined by the use of the evaluation system shown in FIG. 1. On the basis of its value, the process conditions were optimized to make member arrangement and contact angles appropriate. The standard deviation per 1 gf/cm of linear pressure applied to the blade was 1.2 gf and 1.4 gf in respect of the blade hardness of 71 and 74 degrees, respectively.

Comparative Example 2

Using the plasma CVD system shown in FIG. 6, a charge injection blocking layer (lower layer) and a photoconductive layer were deposited on a cylindrical aluminum substrate under conditions shown in Table 12, thus photosensitive drums were produced. The layer corresponding to the surface layer in Example 6 was not formed.

Process conditions under which the above photosensitive drums were used were the same as those in Example 6. In the photosensitive drum having no surface layer, it is known that the process conditions can be optimized to a certain extent by, e.g., making the cleaning blade have a higher hardness. However, they dared not to optimize the process conditions. Here, in the measurement using the evaluation system shown in FIG. 1, the standard deviation per 1 gf/cm of linear pressure applied to the blade was 2.7 and 2.2 in respect of the blade hardness of 71 and 74 degrees, respectively.

Using the above photosensitive drums and under the above conditions, the following evaluation was made.

Evaluation 1

Evaluation on Toner Melt-Adhesion

The photosensitive drums produced in Example 1 and Comparative Example 1 were each set in an electrophotographic apparatus (NP6060, manufactured by CANON INC.) modified for test purpose, and environment easily causative of melt-adhesion was produced by setting the drum surface temperature to 60° C. Using an accelerated test machine thus modified, a 100,000-sheet paper-feed durability test was made using an original with area percentage of 1% (an original on which only straight lines were drawn in the diagonal direction of an A4-size sheet). After running, a halftone image was copied to examine whether or not any melt-adhesion occurred. Stated specifically, a region parallel to the direction of a generatrix of the drum was taken in an A4-size halftone image, and the number of 0.3 mm or larger black dots due to melt-adhesion of toner, present in that region, was estimated to obtain results in respect of five sheets of copy samples.

Evaluation criteria are as follows:

A: No black dots are seen at all.

B: Black dots of 0.3 mm or smaller are seen a few or so.

C: Black dots larger than 0.3 mm are seen a few or so.

D: Black dots larger than 0.3 mm are seen in a large number.

Evaluation 2

Evaluation of Cleaning Performance

A cleaning performance was evaluated using the modified machine of NP6060. A durability test was made on 100,000 using an entirely black (hereinafter "solid-black") original. After the durability test, a halftone image was copied to examine whether or not any faulty cleaning occurred. Stated specifically, a region parallel to the direction of a generatrix of the drum was taken in an A4-size halftone image, and the area contaminated by faulty cleaning was estimated from five sheets of copy samples. Similar evaluation was made five times to obtain results in respect of the five sheets of copy samples.

Evaluation criteria are as follows:

A: No contamination is seen at all.

B: Contamination is partly seen, but not so conspicuous.

C: Contamination is so partly seen as to be a little conspicuous.

D: Contamination due to faulty cleaning in stripes is seen.

Evaluation 3

Evaluation on Uneven Scrape

Durability to scrape upon long-term service was examined using the modified machine of NP6060. To provide conditions under which uneven scrape tends to occur, a small particle size toner was used and also an original with stripes drawn in parallel to the peripheral direction of the photosensitive drum was used to take copies on 100,000 sheets in such a way that the same part was always rubbed by the small particle size toner having a high rubbing force.

Subsequently, after the influence of ghost was removed, a halftone original was copied to examine whether or not any uneven density occurred. After the uneven density was checked, a potentiometer was inserted to the part positioned at the developing assembly, and the potential at the part corresponding to black and white of the stripes was examined to measure its potential difference.

The greater the potential difference is, the more it indicates that the density is uneven. This evaluation was made on five sheets of halftone copy samples and by potential measurement made five times.

Evaluation criteria are as follows:

The results are expressed as relative values assuming as 50 the evaluation results of Comparative Example 2, and standardized into values of from 0 to 100.

A: 0 to 20 (very good properties).

B: 20 to 40 (good properties).

C: 40 to 60 (properties equivalent to Comparative Example 1).

D: 60 to 100 (having a possibility of problems in practical use).

The results of evaluation of the photosensitive drums of Example 6 and Comparative Example 2 are shown together in Table 14.

In Example 6, any melt-adhesion greater than 0.3 mm little occurred even in the melt-adhesion test set under the conditions easily causative of melt-adhesion and even in the durability test made on 100,000 sheets set as the maximum number of sheets. Also, neither faulty cleaning nor uneven scrape occurred at all.

On the other hand, in Comparative Example 2, the melt-adhesion was seen to occur on about 3,000th sheet and subsequent sheets in the melt-adhesion test, because the copying process conditions were not optimized even though the shape and physical properties of the surface of the photosensitive drum had changed. In the test on cleaning performance, too, what is called blade shake (vibration in a large amplitude) occurred at the stage of tens of thousands of sheets to have caused faulty cleaning. Also, uneven scrape also occurred because any surface layer with a high hardness was not formed.

As can be seen from the foregoing results, the present invention can be most greatly effective in the copying process in which the frictional force per 1 gf/cm of linear pressure applied to the blade is so optimized that its standard deviation in its change with time is 2 gf or below.

Example 7

The same photosensitive drums as those produced in Example 6 (a-S:F surface layer) were used. As process conditions under which the photosensitive drums were used, an elastic rubber blade having a JIS hardness of 74 degrees was used, process speed was set at 450 mm/sec, and a toner having an average particle diameter of 6.5 $\mu$m was used.

First, the cleaning blade contact pressure at which the standard deviation of frictional force in its change with time came to be 2 gf or below was examined by the use of the evaluation system shown in FIG. 1, and process conditions were optimized under conditions of each contact pressure. The above photosensitive drums were each set in an electrophotographic apparatus (NP6060, manufactured by CANON INC.) to make evaluation on the melt-adhesion of toner and cleaning performance in the same manner as in Example 6.

For comparison, using the plasma CVD system shown in FIG. 6, a charge injection blocking layer (lower layer) and a photoconductive layer were deposited on a cylindrical aluminum substrate under conditions shown in Table 12. Thereafter, a surface layer comprised of a-SiC:H was superposed thereon in a thickness of 5,000 angstroms under conditions shown in Table 15, thus photosensitive drums were produced.

On the photosensitive drum thus produced, the cleaning blade contact pressure at which the standard deviation of frictional force in its change with time came to be 2 gf or below was examined by the use of the evaluation system shown in FIG. 1, and evaluation was made similarly.

The results of the foregoing are shown in Table 16.

As can be seen form the above results, good results are obtained on both the melt-adhesion and the cleaning performance under every conditions. Also, the surface layer making use of a-C:F film broadens the range of conditions for the contact pressure at which the standard deviation of frictional force in its change with time come to be 2 gf or below, compared with the instance where the conventional a-SiC type surface layer is used. Thus, it can be confirmed that the present invention is effective also in the range of low contact pressure.

Example 8

The same photosensitive drums as those produced in Example 6 were used. As process conditions under which the photosensitive drums were used, an elastic rubber blade having a JIS hardness of 78 degrees was used, process speed was set at 200, 250, 300, 400 and 500 mm/sec each, and a toner having an average particle diameter of 6.5 $\mu$m was used.

First, the standard deviation of frictional force in its change with time was determined by the use of the evaluation system shown in FIG. 1. On the basis of its value, the process conditions were optimized to make member arrangement and contact angles appropriate. Thereafter, using the above photosensitive drums and under the above conditions, evaluation was made in the same manner as in Example 7.

The results are shown in Table 17.

As shown in Table 17, any melt-adhesion greater than 0.3 mm little occurred in the range of process speed of 300 mm/sec or above. At the process speed of 200 or 250 mm/sec, the melt-adhesion was seen to become a little lower level than at the process speed of 300 mm/sec or above, but all were on the level of "B" (passable).

As can be seen from the foregoing results, in the present invention, the process speed may be at any value but may more preferably be in the range of 300 mm/sec or above.

Example 9

The same photosensitive drums as those produced in Example 6 were used. As process conditions under which the photosensitive drums were used, an elastic rubber blade having a JIS hardness of 70, 75, 80 and 82 degrees each was used, process speed was set at 380 mm/sec, and a toner having an average particle diameter of 6.5 $\mu$m was used.

First, the standard deviation of frictional force in its change with time was determined by the use of the evaluation system shown in FIG. 1. From its value, the process conditions were checked to have been optimized. Thereafter, using the above photosensitive drums and under the above conditions, evaluation was made in the same manner as in Example 7.

The results are shown in Table 18.

At the blade hardness of from 70 to 80 degrees, any melt-adhesion greater than 0.3 mm little occurred and neither faulty cleaning nor uneven scrape occurred.

In those having a blade hardness of 82 degrees, melt-adhesion and faulty cleaning were slightly seen at most. In the one having a blade hardness of 82 degrees, microscopic breaks are seen upon observation of the blade edge after the running is completed, and they are considered to have some relation.

Example 10

The same photosensitive drums as those produced in Example 6 were used. As process conditions under which the photosensitive drums were used, an elastic rubber blade having a JIS hardness of 78 degrees was used, process speed was set at 420 mm/sec, and a toner having an average particle diameter of 5, 7 and 8 $\mu$m each was used.

First, the standard deviation of frictional force in its change with time was determined by the use of the evaluation system shown in FIG. 1. From its value, the process conditions were checked to have been optimized. Thereafter, using the above photosensitive drums and under the above conditions, evaluation was made in the same manner as in Example 7.

The results are shown in Table 19.

In respect of the toners having average particle diameter of 5, 7 and 8 $\mu$m, any melt-adhesion greater than 0.3 mm little occurred and also any faulty cleaning did not occur at all.

Thus, it was found that, in order to make the present invention most greatly effective, it is preferable for the toner to have an average particle diameter of 8 $\mu$m or smaller.

Example 11

Using the plasma CVD system shown in FIG. 6, a charge injection blocking layer (lower layer) and a photoconductive layer were deposited on a cylindrical aluminum substrate under conditions shown in Table 12. Thereafter, an a-C:F film surface layer was formed thereon under conditions shown in Table 20, where the frequency of the high-frequency power was changed to be 0.5, 13.56, 50, 105, 250, 450 and 500 MHz, thus photosensitive drums were respectively produced.

As process conditions under which the above photosensitive drums were used, an elastic rubber blade having a JIS hardness of 76 degrees was used, process speed was set at 320 mm/sec, and a toner having an average particle diameter of 6.5 $\mu$m was used.

First, the standard deviation of frictional force in its change with time was determined by the use of the evaluation system shown in FIG. 1. From its value, the process conditions were checked to have been optimized. Thereafter, using the above photosensitive drums and under the above conditions, evaluation was made in the same manner as in Example 7.

The results are shown in Table 21.

In those produced under conditions of a frequency of from 1 to 450 MHz, any melt-adhesion greater than 0.3 mm little occurred and also any faulty cleaning did not occur at all.

In those produced at a frequency of 0.5 MHz, the melt-adhesion and cleaning performance were on a little low level, but substantially good results were obtained.

In those produced at a frequency of 500 MHz, the melt-adhesion did not occur at all. Cleaning performance was on a little low level, but was substantially good.

As can be seen from these results, the present invention can more preferably be effective when the plasma process used to form the surface layer comprised of a-C:F film is carried out under conditions of a frequency of from 1 to 450 MHz.

As described above, the present invention can provide an image-forming apparatus having a cleaning system which may cause no melt-adhesion of toner to the photosensitive drum surface without regard to environment and also is durable enough to maintain such properties, in particular, an image-forming apparatus that does not cause any faulty images due to melt-adhesion of toner and can form high-quality images.

When the apparatus uses an electrophotographic photosensitive member comprising a cylindrical conductive substrate and having thereon a photoconductive layer formed of a non-single-crystal material mainly composed of silicon atoms at least, and the dynamic frictional force produced between the photosensitive member and the cleaning blade and the photosensitive member surface at the time of cleaning through a toner is so set that its standard deviation in its change with time is 2 gf or below per 1 gf/cm of linear pressure of the cleaning blade, it becomes possible to cause no melt-adhesion of toner to the drum surface and also to broaden the latitude for the contact pressure of the cleaning blade, improve the service life of cleaning blades and photosensitive members and achieve a good cleaning performance.

TABLE 1

| Photosensitive Member Production Conditions (charge injection blocking layer, photoconductive layer) | |
|---|---|
| Charge injection blocking layer: | |
| $SiH_4$ | 350 sccm |
| $H_2$ | 500 sccm |
| $B_2H_6$ | 2,000 ppm |
| NO | 5 sccm |
| High frequency power | 100 W |
| Internal pressure | 53 Pa |
| Substrate temperature | 250° C. |
| Layer thickness | 1 $\mu$m |
| Photoconductive layer: | |
| $SiH_4$ | 500 sccm |
| $H_2$ | 400 sccm |
| High frequency power | 550 W |
| Internal pressure | 67 Pa |
| Substrate temperature | 250° C. |
| Layer thickness | 20 $\mu$m |

TABLE 2

| Photosensitive Member Production Conditions (surface layer) | |
|---|---|
| $CH_4$ | 600 sccm |
| High frequency power | 1,000 W |
| Internal pressure | 53 Pa |
| Substrate temperature | 200° C. |
| Layer thickness | 0.5 $\mu$m |

TABLE 3

| Photosensitive Member Production Conditions (surface layer) | |
|---|---|
| $SiH_4$ | 10 sccm |
| $CH_4$ | 600 sccm |

TABLE 3-continued

| Photosensitive Member Production Conditions (surface layer) | |
|---|---|
| High frequency power | 160 W |
| Internal pressure | 53 Pa |
| Substrate temperature | 200° C. |
| Layer thickness | 0.5 μm |

TABLE 4

| Evaluation Results (Example 1, Comparative Example 1) | | | | |
|---|---|---|---|---|
| Surface layer material | Standard deviation per 1gf/cm | Melt-adhesion proof-ness | Clean-ing perfor-mance | Uneven-scrape resistance |
| Example 1: | | | | |
| Non-single-crystal carbon | 1.4 | AA | AA | AA |
| Non-single-crystal silicon carbide | 1.7 | A | A | AA |
| (No surface layer) | 1.9 | A | A | B |
| Comparative Example 1: | | | | |
| (No surface layer) | 2.2 | B | B | B |

TABLE 5

| Photosensitive Member Production Conditions (surface layer) | |
|---|---|
| $CH_4$ | 150 sccm |
| High frequency power | 1,500 W |
| Internal pressure | 53 Pa |
| Substrate temperature | 200° C. |
| Layer thickness | 0.5 μm |

TABLE 6

| Evaluation Results (Example 2) | | | | |
|---|---|---|---|---|
| Process speed (mm/sec) | Standard deviation per 1gf/cm | Melt-adhesion proofness | Cleaning performance | Uneven-scrape resistance |
| Example 2: | | | | |
| 120 | 1.75 | A | A | AA |
| 200 | 0.75 | AA | AA | AA |
| 400 | 0.82 | AA | AA | AA |
| 600 | 1.5 | AA | AA | AA |

TABLE 7

| Photosensitive Member Production Conditions (surface layer) | |
|---|---|
| $CH_4$ | 150 sccm |
| $H_2$ | 200 sccm |
| High frequency power | 1,200 W |
| Internal pressure | 53 Pa |
| Substrate temperature | 200° C. |
| Layer thickness | 0.5 μm |

TABLE 8

| Evaluation Results (Example 3) | | | | |
|---|---|---|---|---|
| Blade hardness (degrees) | Standard deviation per lpf/cm | Melt-adhesion proofness | Cleaning performance | Uneven-scrape resistance |
| Example 3: | | | | |
| 58 | 1.8 | A | A | AA |
| 60 | 1.7 | AA | AA | AA |
| 70 | 1.1 | AA | AA | AA |
| 80 | 1.57 | AA | AA | AA |
| 82 | 1.8 | A | AA | AA |

TABLE 9

| Evaluation Results (Example 4) | | | | |
|---|---|---|---|---|
| Toner average particle diameter (μm) | Standard deviation per 1gf/cm | Melt-adhesion proof-ness | Cleaning performance | Uneven-scrape resistance |
| Example 4: | | | | |
| 5 | 1.6 | AA | A | A |
| 6 | 1.4 | AA | AA | AA |
| 7 | 1.0 | AA | AA | AA |
| 8 | 1.5 | AA | AA | AA |
| 9 | 1.9 | A | AA | AA |

TABLE 10

| Photosensitive Member Production Conditions (surface layer) | |
|---|---|
| $CH_4$ | 150 sccm |
| High frequency power | 1,500 W |
| Frequency | 13.56, 50, 105, 250, 450 MHz |
| Internal pressure | 53 Pa |
| Substrate temperature | 200° C. |
| Layer thickness | 0.5 μm |

TABLE 11

| Evaluation Results (Example 5) | | | | |
|---|---|---|---|---|
| Frequency of high frequency power (MHz) | Standard deviation per 1gf/cm | Melt-adhesion proofness | Cleaning performance | Uneven-scrape resistance |
| Example 5: | | | | |
| 13.56 | 1.0 | AA | AA | AA |
| 50 | 0.7 | AA | AA | AA |
| 105 | 0.8 | AA | AA | AA |
| 250 | 1.0 | AA | AA | AA |
| 450 | 1.1 | AA | AA | AA |

TABLE 12

| Photosensitive Member Production Conditions (charge injection blocking layer, photoconductive layer) | |
|---|---|
| Charge injection blocking layer: | |
| $SiH_4$ | 400 sccm |
| $H_2$ | 500 sccm |
| $B_2H_6$ | 2,000 ppm |
| NO | 5 sccm |
| High frequency power | 150 W |
| Internal pressure | 53 Pa |
| Substrate temperature | 250° C. |
| Layer thickness | 1 μm |
| Photoconductive layer: | |
| $SiH_4$ | 500 sccm |
| $H_2$ | 400 sccm |
| High frequency power | 600 W |
| Internal pressure | 67 Pa |
| Substrate temperature | 250° C. |
| Layer thickness | 20 μm |

TABLE 13

| Photosensitive Member Production Conditions (surface layer) | |
|---|---|
| $C_2F_6$ | 200 sccm |
| $H_2$ | 200 sccm |
| High frequency power | 150 W |
| Internal pressure | 53 Pa |
| Substrate temperature | 200° C. |
| Layer thickness | 0.5 μm |

TABLE 14

| Evaluation Results (Example 6, Comparative Example 2) | | | |
|---|---|---|---|
| Standard deviation per 1 gf/cm | Melt-adhesion proofness | Cleaning performance | Uneven-scrape resistance |
| Example 6: | | | |
| 1.2 | A | A | A |
| 1.4 | A | A | A |
| Comparative Example 2: | | | |
| 2.2 | C | C | C |
| 2.7 | C | C | C |

TABLE 15

| Photosensitive Member Production Conditions (surface layer) | |
|---|---|
| $SiH_4$ | 20 sccm |
| $CH_4$ | 500 sccm |
| High frequency power | 150 W |
| Internal pressure | 53 Pa |
| Substrate temperature | 200° C. |
| Layer thickness | 0.5 μm |

TABLE 16

| Evaluation Results (Example 7) | | | |
|---|---|---|---|
| Blade contact pressure* | Standard deviation per 1gf/cm | Melt-adhesion proofness | Cleaning Performance |
| Example 7 | | | |
| a-C:F: | | | |
| 5 | 1.8 | A | A |
| 3 | 1.7 | A | A |
| 1 | 1.4 | A | A |
| ½ | 1.2 | A | A |
| ⅓ | 0.8 | A | A |
| ¼ | 1.0 | A | A |
| ⅕ | 1.2 | A | A |
| a-SiC: | | | |
| 2 | 2.0 | A | A |
| 1.5 | 1.8 | A | A |
| 1 | 1.7 | A | A |
| ½ | 1.5 | A | A |
| ⅓ | 1.8 | A | A |

*Relative value assuming the blade contact pressure in Example 6 as 1.

TABLE 17

| Evaluation Results (Example 8) | | | |
|---|---|---|---|
| Process speed (mm/sec) | Standard deviation per 1gf/cm | Melt-adhesion proofness | Cleaning performance |
| Example 8: | | | |
| 200 | 2.0 | B | A |
| 250 | 1.8 | B | A |
| 300 | 1.1 | A | A |
| 400 | 1.4 | A | A |
| 500 | 1.3 | A | A |

TABLE 18

| Evaluation Results (Example 9) | | | |
|---|---|---|---|
| Blade hardness (degrees) | Standard deviation per 1gf/cm | Melt-adhesion proofness | Cleaning performance |
| Example 9: | | | |
| 70 | 1.8 | A | A |
| 75 | 1.4 | A | A |
| 80 | 1.3 | A | A |
| 82 | 1.2 | B | B |

TABLE 19

| Toner average particle diameter (μm) | Evaluation Results (Example 10) Standard deviation per 1gf/cm | Melt-adhesion proofness | Cleaning performance |
|---|---|---|---|
| Example 10: | | | |
| 5 | 1.2 | A | A |
| 7 | 1.1 | A | A |
| 8 | 1.4 | A | A |

TABLE 20

| Photosensitive Member Production Conditions (surface layer) | |
|---|---|
| $C_2F_6$ | 150 sccm |
| $H_2$ | 150 sccm |
| High frequency power | 150 W |
| Frequency | 0.5, 1, 13.56, 50, 105, 250, 450, 500 MHz |
| Internal pressure | 53 Pa |
| Substrate temperature | 200° C. |
| Layer thickness | 0.5 μm |

TABLE 21

| Frequency of high frequency power (MHz) | Evaluation Results (Example 11) Standard deviation per 1gf/cm | Melt-adhesion proofness | Cleaning performance |
|---|---|---|---|
| Example 11: | | | |
| 0.5 | 1.9 | B | B |
| 1 | 1.6 | A | A |
| 13.56 | 1.4 | A | A |
| 105 | 0.9 | A | A |
| 250 | 1.1 | A | A |
| 450 | 1.7 | A | A |
| 500 | 1.8 | A | B |

What is claimed is:

1. An image-forming apparatus comprising:

an electrophotographic photosensitive member including a conductive substrate and having thereon a photoconductive layer formed of a non-single-crystal material mainly composed of at least silicon atoms wherein charging, exposure, development and cleaning in the image forming apparatus are repeated while rotating the photosensitive member;

a cleaning blade in the image forming apparatus for cleaning the surface of the photosensitive member to remove a developer remaining on that surface, wherein a dynamic frictional force (unit: gf) produced between the cleaning blade and the photosensitive member surface is so set that its standard deviation in its change with time is 2 gf or below per 1 gf/cm of linear pressure of the cleaning blade.

2. The image-forming apparatus according to claim 1, wherein the photosensitive member includes a surface layer formed of a non-single-crystal material.

3. The image-forming apparatus according to claim 2, wherein the surface layer formed of a non-single-crystal material is mainly composed of at least silicon atoms and carbon atoms.

4. The image-forming apparatus according to claim 2, wherein the surface layer formed of a non-single-crystal material comprises non-single-crystal carbon.

5. The image-forming apparatus according to claim 4, wherein the non-single-crystal carbon contains fluorine atoms.

6. The image-forming apparatus according to claim 5, wherein movement of the photosensitive member surface by the rotation of the photosensitive member is set at a speed of 300 mm/sec or above.

7. The image-forming apparatus according to claim 5, wherein the cleaning blade has a JIS hardness of from 70 degrees to 80 degrees.

8. The image-forming apparatus according to claim 1, wherein movement of the photosensitive member surface by the rotation of the photosensitive member is set at a speed within the range of from 200 10 mm/sec to 600 mm/sec.

9. The image-forming apparatus according to claim 1, wherein the cleaning blade is made of a material comprising a urethane rubber.

10. The image-forming apparatus according to claim 1, wherein the cleaning blade has a JIS hardness of from 60 degrees to 80 degrees.

11. The image-forming apparatus according to claim 1, wherein the developer has an average particle diameter of 8 μm or smaller.

12. The image-forming apparatus according to claim 1, wherein the photosensitive member further comprises a charge injection blocking layer provided between the conductive substrate and the photoconductive layer.

13. The image-forming apparatus according to claim 1, wherein the photosensitive member further comprises a charge injection blocking layer provided between the conductive substrate and the photoconductive layer, and a surface layer provided on the surface of the photosensitive member.

14. The image-forming apparatus according to claim 1, wherein the substrate is cylindrical.

15. An image-forming method making use of an electrophotographic photosensitive member comprising a conductive substrate and having thereon a photoconductive layer formed of a non-single-crystal material mainly composed of silicon atoms at least wherein charging, exposure, development and cleaning in the image forming method are repeated while rotating the photosensitive member, the method comprising:

a cleaning step for cleaning the surface of the photosensitive member with a cleaning blade to remove a developer remaining on that surface in which a dynamic frictional force (unit: gf) produced between the cleaning blade and the photosensitive member surface is so set that its standard deviation in its change with time is 2 gf or below per 1 gf/cm of linear pressure of the cleaning blade.

16. The image-forming method according to claim 15, wherein the photosensitive member has a surface layer on its surface.

17. The image-forming method according to claim 16, wherein the surface layer comprises a non-single-crystal material mainly composed of at least silicon atoms and carbon atoms.

18. The image-forming method according to claim 16, wherein the surface layer comprises a non-single-crystal material mainly composed of at least carbon atoms.

19. The image-forming method according to claim 18, wherein the non-single-crystal carbon contains fluorine atoms.

* * * * *

UNITED STATES PATENT AND TRADEMARK OFFICE

CERTIFICATE OF CORRECTION

PATENT NO. : 6,282,400 B1
DATED : August 28, 2001
INVENTOR(S) : Makoto Aoki et al.

It is certified that error appears in the above-identified patent and that said Letters Patent is hereby corrected as shown below:

Column 2,
Line 42, "come" should read -- comes --.

Column 3,
Line 15, "sever" should read -- severe --.

Column 5,
Line 49, "has" should read -- have --; and
Line 52, "stand" should read -- comes about --.

Column 6,
Line 18, "come" should read -- comes --.

Column 9,
Line 54, "film" should read -- film is used --.

Column 20,
Line 13, "every" should read -- all --; and
Line 16, "come" should read -- comes --.

Column 28,
Line 23, "10" should be deleted.

Signed and Sealed this

Ninth Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,282,400 B1
DATED : August 28, 2001
INVENTOR(S) : Makoto Aoki et al.

It is certified that error appears in the above-identified patent and that said Letters Patent is hereby corrected as shown below:

Drawings,
Figure 1, "PHOTOSENSITIVE MEMBER" should read -- CLEANING BLADE--.

Signed and Sealed this

Sixth Day of July, 2004

JON W. DUDAS
*Acting Director of the United States Patent and Trademark Office*